US009480122B2

(12) United States Patent
Trattler et al.

(10) Patent No.: US 9,480,122 B2
(45) Date of Patent: Oct. 25, 2016

(54) OPTICAL SENSOR CIRCUIT, LUMINOUS PANEL AND METHOD FOR OPERATING AN OPTICAL SENSOR CIRCUIT

(71) Applicant: ams AG, Unterpremstätten (AT)

(72) Inventors: Curd Trattler, Judendorf-Strassengel (AT); Peter Trattler, Graz (AT)

(73) Assignee: AMS AG, Unterpremstaetten (AT)

( * ) Notice: Subject to any disclaimer, the term of this patent is extended or adjusted under 35 U.S.C. 154(b) by 177 days.

(21) Appl. No.: 14/276,960

(22) Filed: May 13, 2014

(65) Prior Publication Data

US 2014/0339986 A1 Nov. 20, 2014

(30) Foreign Application Priority Data

May 15, 2013 (EP) ..... 13167847
Jan. 22, 2014 (EP) ..... 14152147

(51) Int. Cl.
*H05B 33/08* (2006.01)

(52) U.S. Cl.
CPC ..... *H05B 33/0872* (2013.01); *H05B 33/0851* (2013.01)

(58) Field of Classification Search
None
See application file for complete search history.

(56) References Cited

U.S. PATENT DOCUMENTS 8,324,830 B2 * 12/2012 Peker ..... H05B 33/086 315/291
2007/0216611 A1 9/2007 Chang
2007/0216622 A1 * 9/2007 Kim ..... G09G 3/2003 345/88
2008/0074872 A1 * 3/2008 Panotopoulos .... H05B 33/0869 362/231
2009/0167195 A1 7/2009 Katsu
2009/0224678 A1 * 9/2009 Wang ..... G09G 3/3426 315/158
2009/0284692 A1 11/2009 Yang et al.
2010/0207531 A1 8/2010 Peker et al.
2011/0187273 A1 * 8/2011 Summerford ..... H05B 41/16 315/152
2011/0279040 A1 * 11/2011 Briggs ..... H05B 33/0818 315/136
2012/0081033 A1 4/2012 Sun et al.
2012/0188207 A1 7/2012 Usukura et al.

FOREIGN PATENT DOCUMENTS

WO 2008/105093 A1 9/2008

* cited by examiner

*Primary Examiner* — Crystal L Hammond
(74) *Attorney, Agent, or Firm* — McDermott Will & Emery LLP

(57) ABSTRACT

An optical sensor circuit comprises an optical sensor (DET) designed to provide a sensor signal indicative of light incident on the optical sensor (DET). A clock terminal (CLK) is used to receive a clocked control signal comprising high and low states. A controller unit (CU) is connected to the optical sensor (DET) and to the clock terminal (CLK). The controller unit (CU) is designed to process the sensor signal as a color signal (CTS) in a first mode if the clocked control signal is in high state, and process the sensor signal as an ambient light signal (ALS) in a second mode if the clocked control signal is in low state, and further designed to generate a driving signal (PWM) to drive a light emitting device (LED) to be connected at a control terminal (OUT). The driving signal (PWM) depends on the color and ambient light signal (CTS, ALS).

15 Claims, 4 Drawing Sheets

Figure 1:
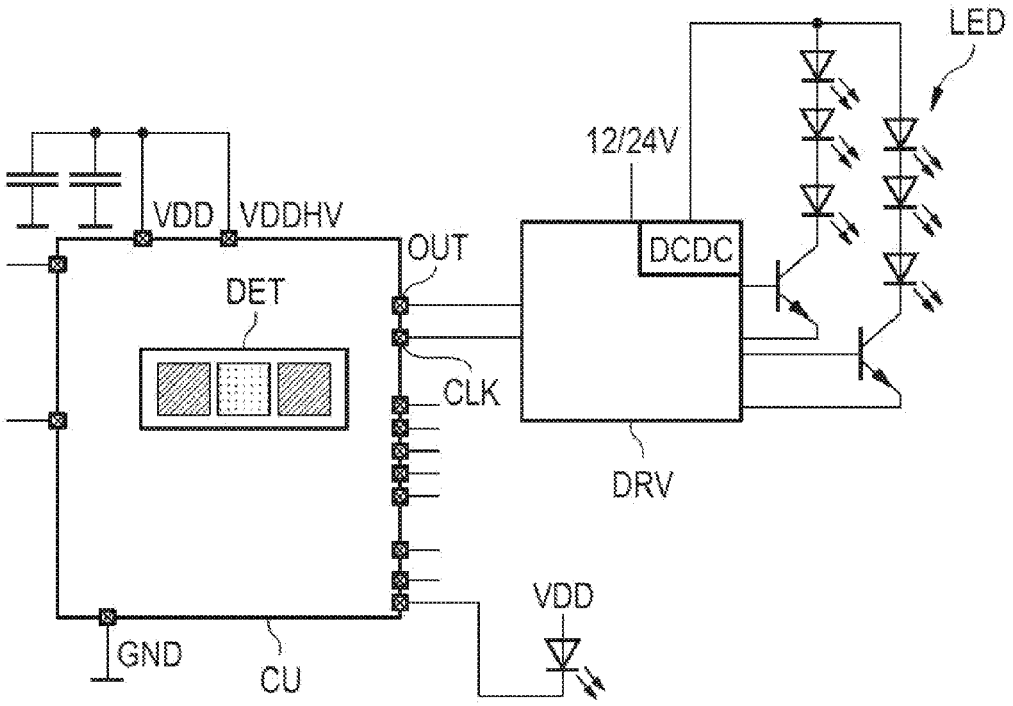

OPTICAL SENSOR CIRCUIT, LUMINOUS PANEL AND METHOD FOR OPERATING AN OPTICAL SENSOR CIRCUIT

This invention relates to an optical sensor circuit, a luminous panel and a method for operating an optical sensor circuit.

Light emitting diodes or LEDs find increasing application in electric lighting. For example, flat light luminaries or panels comprise diffusers framed by an array of LEDs to illuminate larger areas and are applied in back light illuminated displays and LED light guides. The next generation of such flat light luminaries might be equipped with an ambient light sensor and a color sensor. The color sensor is placed behind light guide and diffuser in order to measure the color temperature. The color temperature can be adjusted by mixing cold and warm white LEDs, so called tunable white. The ambient light sensor is placed on a small printed circuit board (PCB) behind an opening in the frame of the luminary, e.g. behind a drilled hole. The drilled hole and the additional PCB are undesirable by the luminary manufactures as they break the aesthetic of the luminary itself and need additional processing steps during manufacturing which add to cost of the device.

There is a need in the art to provide for an optical sensor circuit, luminous panel and a method for operating an optical sensor circuit to avoid the above-mentioned drawbacks.

According to an aspect of the invention, an optical sensor circuit comprises an optical sensor, a clock terminal and a controller unit connected to both the optical sensor and the clock terminal. The optical sensor is designed to provide a sensor signal indicative of incident light. At the clock terminal, a clocked control signal can be received. The clocked control signal comprises high and low states. The controller unit further comprises a control terminal to be connected with a light-emitting device or an array of light-emitting devices.

In operation the optical sensor is exposed to light which may originate from several sources. Depending on the properties of light incident on the optical sensor the sensor generates a sensor signal. Via the connection to the controller unit the sensor signal is provided to the controller unit. At the same time the controller unit receives the clocked control signal. Depending on the states, i.e. high or low, of the control signal at least two different modes of operation are set in the controller unit. Depending on the set mode of operation the controller unit performs signal processing of the sensor signals with respect to different properties of the incident light. In particular, the sensor signal is processed as a colour signal in a first mode if the clocked control signal is in high state. The sensor signal is processed as an ambient light signal in a second mode if the clocked control signal is in low state.

Depending on the processing, i.e. colour or ambient light signal processing according to the first and second mode, respectively, the controller unit generates a driving signal which is used to drive the light-emitting device to be connected at the control terminal. The driving signal depends on the colour and ambient light signal.

The term "light" hereinafter denotes electromagnetic radiation in the visible but can also include parts of the infrared and ultraviolet. Ambient light refers to any source of light that is not explicitly controlled by the optical sensor circuit, i.e. when connected to a light emitting device. The colour of light, i.e. detected via the colour signal is a function of wavelength. For example, the colour signal can be an explicit function of wavelength or be integrated over a given spectral range. A clocked signal hereinafter comprises at least one high and low state, typically a succession of these states. The driving signal, for example, can be a clocked driving signal.

Preferably, a clocked signal is a function of high and low state but does not necessarily have to be periodic. For example, a clocked signal can be of pulse width modulation type. For example, the pulse width modulation can be used as control signal for driving the light-emitting devices. The high and low states then correspond to on and off states of the light-emitting device. Preferably, light emitting diodes are used as light-emitting devices. However, other sources are possible as well, like fluorescent or incandescent lamps. If these light-emitting devices are light-emitting diodes, the pulse width modulation can be used to adjust brightness and/or colour via a duty cycle of the modulation signal.

The described optical sensor circuit allows for ambient light measurement and colour measurement using just a single optical sensor. The controller unit evaluates the sensor signal as colour signal or ambient light signal using just the single sensor unit. This has the benefit of smaller size and reduced cost of the implementation of the circuit. Furthermore, there is no need to drill a hole into a luminary panel to be used with the optical sensor circuit or even an additional printed circuit board to host a dedicated ambient light sensor. In fact, the sensor can be made non-visible so as to reside behind a diffuser and detect through the diffuser. An optical separation of an ambient light sensor from a luminary is therefore not required. This allows for improved freedom of design of the luminary panel as there is no need to take of a light sensor by design.

According to another aspect of the invention, the clock terminal is coupled to the control terminal such that the clocked control signal is synchronized to the clocked driving signal.

The first and second mode of operation of the optical sensor circuit make use of the timing differences of the clocked control signal wherein timing refers to the temporal succession of high and low states. In fact, the states of the clocked signal indicate the controller unit to process the sensor signal as an ambient light signal or as colour signal.

One convenient source for the clocked control signal is via the driving signal provided at the control terminal. This driving signal is a clocked signal. The clocked control signal allows for separating the ambient light processing from the colour light processing by synchronizing the detection via the optical sensor to the driving signal. Thereby the processing is synchronized to the state of the light emitting device, e.g. whether the light emitting device is turned on or off.

Preferably, during the low state of the control signal the light-emitting device is off. As no light is emitted in this state, and ambient light measurement is synchronized, only light originating from the surroundings of the optical sensor circuit is recorded by the optical sensor. During the high state of the control signal the colour processing is executed. During this the light-emitting device is turned on. The sensor signals therefore record the light emitted by the light-emitting device and the light originating from the surroundings as ambient light signal.

According to another aspect of the invention the clock terminal is coupled to the optical sensor such that the clocked control signal is synchronized to the sensor signal.

Instead of using the driving signal to synchronize, the sensor signal can be used. The light-emitting device is driven by the driving signal which is clocked into high and low states as well. Accordingly, the optical sensor will detect a low level and high level indicating that the light-emitting device is switched on and off, respectively. The succession of high and low states received in this manner can be used to generate a control signal from the sensor signal. The operation of a controller unit can then be synchronized to this detected sensor signal. For example, the sensor signal indicates different brightness level of light emitted by the light-emitting device.

According to another aspect of the invention, the optical sensor is a colour sensor. The colour sensor can be a single device characterized by an overall spectral responsivity or can comprise several elements each being sensitive to a specific spectral range or wavelength.

According to another aspect of the invention, the colour sensor comprises at least two sensor elements, in particular three sensor elements. Each of these sensor elements is sensitive to a corresponding spectral range of light and/or connected to a corresponding optical filter.

The sensor elements can be constructed to be sensitive only to a certain spectral range of light. The sensitivity can also be adjusted or additionally controlled by using optical filters which are attached to the individual sensor elements. In this way, for example, red, green and blue spectral ranges can be selected and the respective sensor signals from the individual sensor elements contain spectral properties of the light incident on the optical sensor circuit. A spectral response curve can thus be constructed. For example, the sensor elements can be photodiodes, charge coupled devices or avalanche photodiodes.

According to another aspect of the invention, the at least two sensor elements each generate respective sensor sub-signals indicative of light incident on the optical sensor. The controller unit comprises means to combine the sensor sub-signals as a function of wavelength of light. Then, the sensor sub-signals are processed by the controller unit as the colour signal indicating the colour of light emitted by the light-emitting device. On the other side, the controller unit also comprises means to combine the sensor sub-signals into the ambient light signal. In this case the ambient light signal is processed, indicating the level of ambient light. For example, adding the sub-signals from the individual sensor elements results in an integral sensor signal which gives a measure of ambient light.

According to another aspect of the invention the driving unit comprises a signal-to-frequency converter. The sensor signal, typically a photo current, can be measured as signal amplitude or, using the signal-to-frequency converter, as a number of counts per unit time. The sensor signals are recorded for a given period of time. The signal-to-frequency converter is used to accumulate the sensor signal depending on a frequency signal applied to the converter. The more counts the optical sensor generates the stronger the sensor signal, and vice versa.

According to another aspect of the invention, a driver circuit is connected between the control terminal and the light-emitting device. A DC/DC converter is used to supply a current to the light-emitting device. A controller circuit is used to adjust brightness and/or colour of the light-emitting device depending on the driving signal. The driver circuit can either be an integral part of the optical sensor circuit and be integrated on the same die or connected externally.

According to another aspect of the invention the controller unit comprises a microcontroller and/or control logic. The functionality of the optical sensor circuit as described herein can be realized by appropriate programming of the microcontroller. Alternatively, or in addition, some or all of the presented units can be realized by logical components. For example, the optical sensor circuit can be implemented as an application-specific integrated circuit (ASIC).

According to an aspect of the invention, a luminous panel comprises a transparent luminary board, an array of light-emitting devices connected to the luminary board, an optical sensor circuit is also included according to the principles presented above and electrically connected to the array of light-emitting devices. Preferably, light-emitting diodes are used as light-emitting devices.

In the first mode of operation the array of light emitting diodes is turned on and, in addition to ambient light, light is emitted by the panel and reflected from nearby surfaces as reflected light back to the panel and the optical sensor. Consequently, the optical sensor detects both emitted light and ambient light as sensor signal. In the second mode of operation the array of light emitting diodes is turned off and no light is emitted from the panel. The optical sensor in this mode only detects ambient light AL reflected from the surroundings into the panel as reflected light.

The luminous panel preferably comprises a diffuser, a light guide, and a reflector which are connected with each other in a stacked fashion. The light guide is framed with the array of light emitting diodes. The light guide is adapted to guide light emitted from the light emitting diodes. The guided light will predominately enter the diffuser. The light will leave the panel as emitted light in a directed fashion. This happens either directly via the diffuser or indirectly after being reflected at reflector.

According to another aspect of the invention, the light-emitting devices comprise red, green and blue light-emitting diodes. Additionally, or alternatively, white light-emitting diodes, in particular light emitting diodes with different color temperature, e.g. cold and warm white light-emitting diodes, can be used. This way brightness and/or colour of light emitted by the array can be altered by adjusting individual light-emitting diodes from the array, e.g. by changing the duty cycle of the driving signal.

According to another aspect of the invention, a method for an optical sensor circuit comprises the step of receiving light by means of an optical sensor and providing a sensor signal indicate of the incident light. Then, a clocked control signal is received comprising high and low states. The sensor signal is selectively processed as a colour signal in a first mode if the clocked control signal is in a high state, or processed as an ambient light signal in a second mode if the clocked control signal is in low state. Finally, a clocked driving signal is generated to drive a light-emitting device depending on the colour and ambient light signal.

Measurement of ambient light measurement and colour measurement can be achieved by using just a single optical sensor. The sensor signal can be processed both as colour signal or ambient light signal. This has the benefit of smaller size and reduced cost of the implementation in a circuit. Furthermore, there is no need to drill a hole into a luminary panel to be used with the optical sensor circuit or even an additional printed circuit board to host a dedicated ambient light sensor. In fact, the sensor can be made non-visible so as to reside behind a diffuser and detect through the diffuser. An optical separation of an ambient light sensor from a luminary is therefore not required. This allows for improved freedom of design of the luminary panel as there is no need to take care of a light sensor by design.

According to another aspect of the invention, the method further comprises the step of synchronizing the clocked control signal to the driving signal.

According to another aspect of the invention, the step of synchronizing the clocked signal is performed with respect to the sensor signal.

According to another aspect of the invention in the first mode, the control signal is processed so as to indicate a colour of light emitted by the light-emitting device. Furthermore, in the second mode the ambient light signal is processed so as to indicate the level of ambient light.

In the following, the principle presented above will be described in more detail with respect to drawings in which exemplary embodiments are presented.

Figure 2:
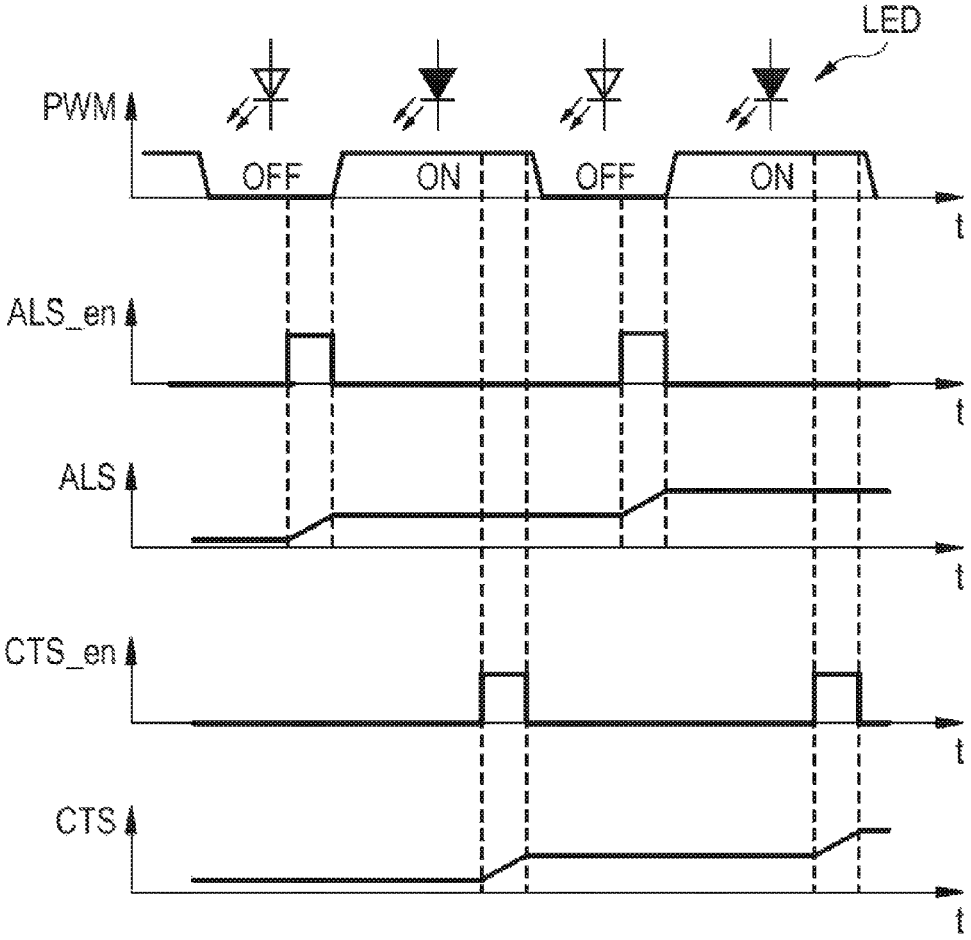
Figure 3A:
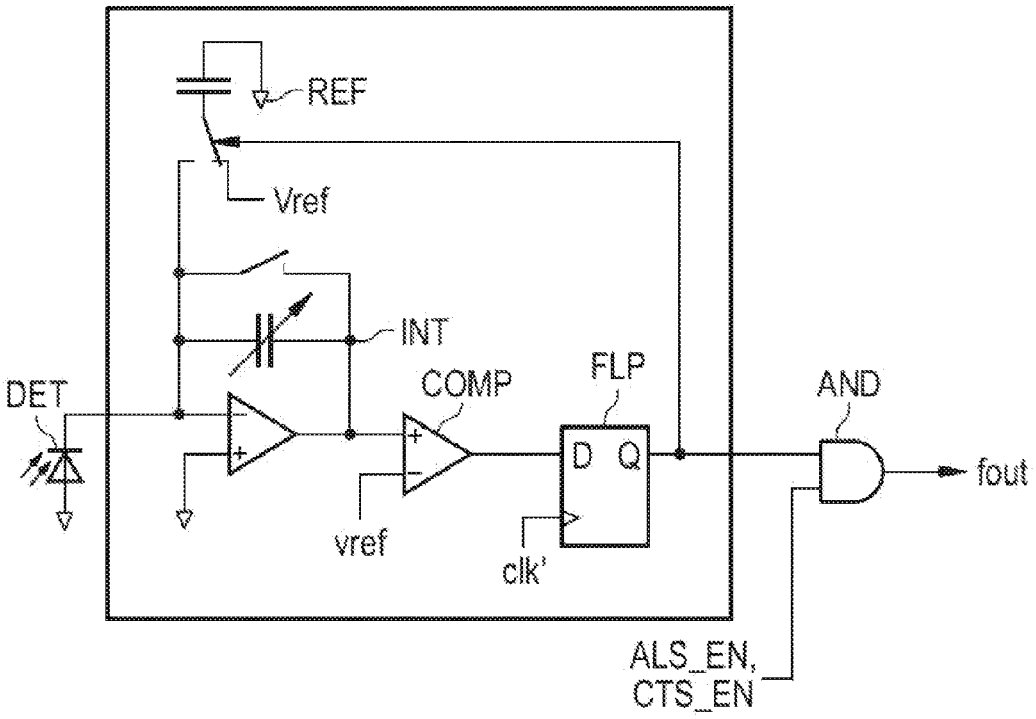
Figure 3B:
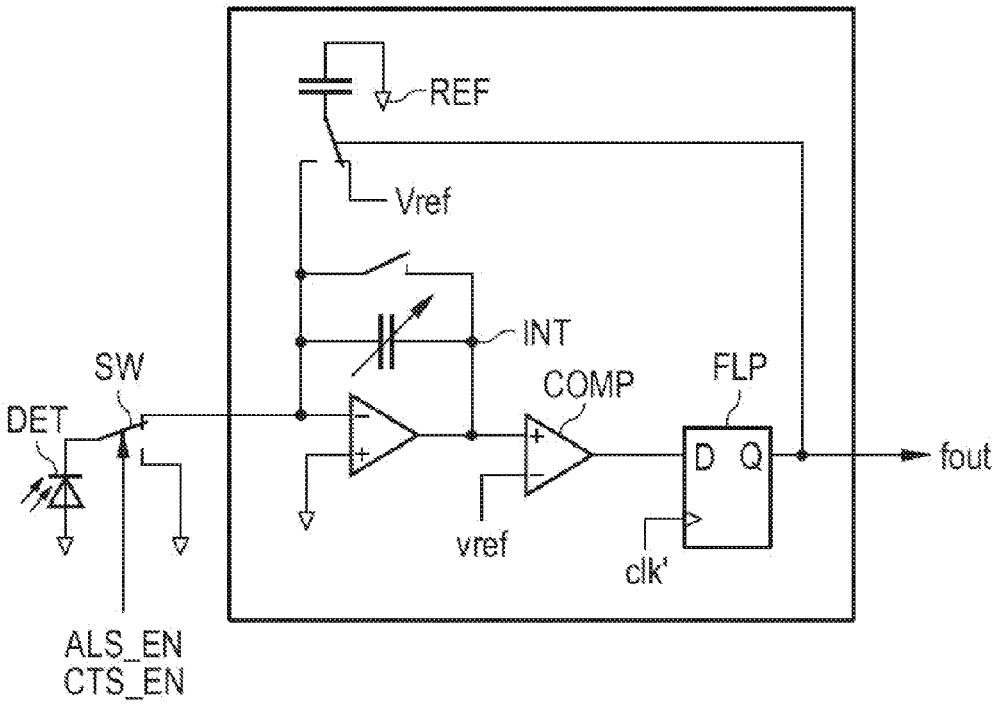
Figure 4A:
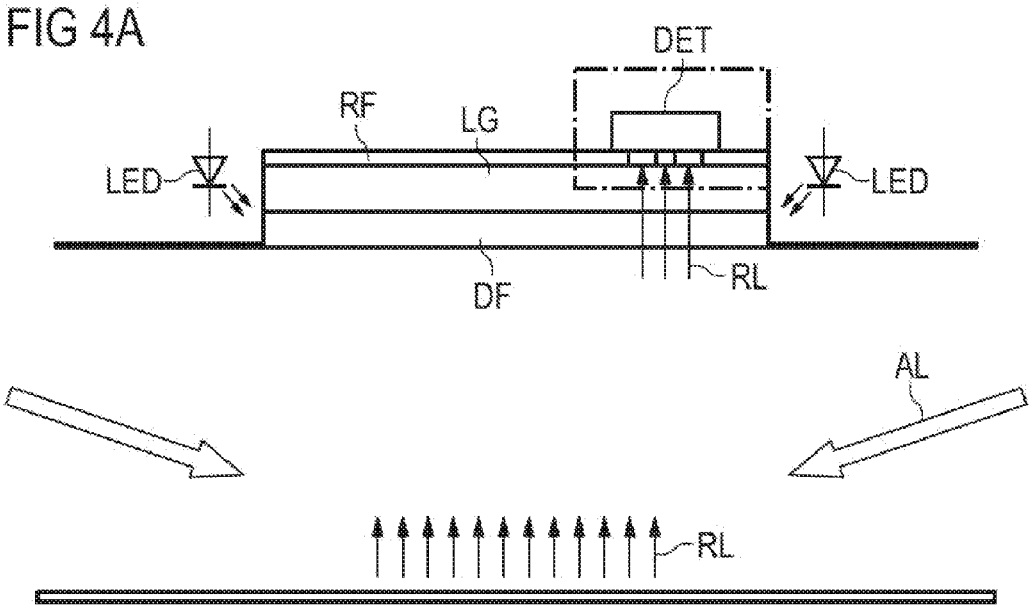
Figure 4B:
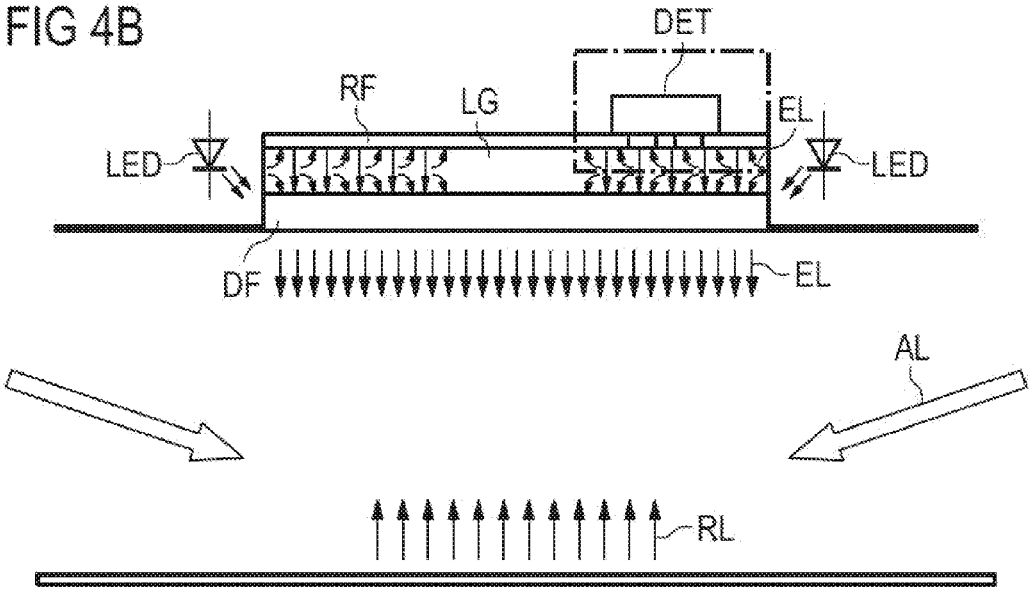

FIG. 1 shows an exemplary embodiment of an optical sensor circuit according to the principle presented, FIG. 2 shows an exemplary timing diagram of an optical sensor circuit according to the principle presented, FIGS. 3A and 3B show exemplary embodiments of a current-to-frequency converter according to the principle presented, and FIGS. 4A and 4B show an exemplary embodiment of a luminous panel according to the principle presented.

FIG. 1 shows an exemplary embodiment of an optical sensor circuit according to the principle presented. The optical sensor circuit comprises a controller unit CU, an optical sensor DET and several terminals. The terminals comprise a clock terminal CLK and a control terminal OUT. Other terminals can be provided but will not be described in further detail. Such terminals can be related to additional functionality of the controller unit CU such as dimming, switching, occupancy detection and programming.

The controller unit CU is connected to the optical sensor DET. Furthermore, the controller unit CU is connected to clock and control terminals CLK, OUT. All these components are preferably integrated into a common integrated circuit structure but may just as well be separate units. In particular, the optical sensor DET can be integral part of an integrated optical sensor circuit or an external component connected to the remaining circuit. The controller unit CU comprises a microcontroller or control logic. The controller unit may be an application-specific integrated circuit or ASIC. The components and functionality will be described in more detail below and can be implemented as dedicated hardware components like control logic, or as programmed units of the microcontroller.

The optical sensor DET preferably is a colour sensor. The colour sensor comprises a single or several sensor elements like photodiodes or charge coupled devices which are sensitive to visual light. The colour sensor generates a sensor signal which depends on wavelength. The spectral response can be realized by a single sensor element, for example by recording several sensor signals each being spectrally separated by appropriate means such as filters, prisms or gratings. The filters have characteristic spectral transmission curves. Alternatively, several sensor elements can be used to generate respective sub-signals. Each sensor element can be sensitive to a different colour or spectral range. Again, this can be implemented by filters, prisms or gratings being attached to the respective sensor element. Or the sensor elements already generate the sub-signals as a function of wavelength. In any of theses cases the resulting sensor sub-signals are indicative of the colour of light they detect and can be processed individually or be combined to a colour signal.

The optical sensor circuit further comprises a driver circuit DRV which is connected to the clock and control terminals CLK, OUT. Furthermore, the driver circuit DRV is connected to an array of light emitting devices LED. A DC/DC converter is used to supply a current to light-emitting devices LED. A controller circuit is used to adjust brightness and/or colour of the light-emitting device. The driver circuit can either be an integral part of the optical sensor circuit and be integrated on the same die or connected externally.

The light emitting devices LED are connected to the driver circuit DRV. Preferably, the light emitting devices are light emitting diodes, for example cold and warm white LEDs (tunable white) and/or colored LEDs such as red, green, and blue.

The operating principle of the optical sensor circuit described above will be discussed with respect to FIG. 2. FIG. 2 shows an exemplary timing diagram of an optical sensor circuit according to the principle presented. The drawing shows a driving signal PWM, an ambient light enable signal ALS_en, an ambient light signal ALS, a colour enable signal CTS_en, and a colour signal CTS as functions of time t. Light emitting devices are sketched with their electronic symbol. The electronic symbol filled with grey indicates light emitting device being switched on and filled with white indicates the light emitting device being switched off.

The operation of the optical sensor is synchronized to the timing of a clocked control signal to be provided at the control terminal CLK. In the present embodiment the clocked control signal is derived from the driving signal PWM of the light emitting devices. In fact, the drawing shows the driving signal PWM comprising high and lows states which correlate to the LEDs being switched on or off, respectively. This is also indicated by the different colouring of the LED electronic symbols in the drawing. By switching the LEDs according to the driving signal PWM both brightness and/or colour can be adjusted.

The operation of the controller unit CU is synchronized to the timing of the clocked control signal, i.e. in this embodiment the driving signal PWM. Depending on this driving signal PWM the controller unit CU enters a first or second mode of operation in which the sensor signal from the optical sensor is processed differently.

In every high state ON of the driving signal PWM the controller unit CU issues the colour enable signal CTS_en and enters into the first mode. In this mode the sensor signal is processed as a colour signal CTS. The colour signal CTS includes information of the light emitted by the LEDs as it is synchronized to states in which the LEDs are turned on. However, the optical sensor also records ambient light which is present as well. The colour signal can be corrected for ambient light, for example, by subtracting the ambient light signal ALS to be recorded in the second mode. In any case the colour signal includes information on the colour of the light emitted by the LEDs as the optical sensor generates a wavelength dependent sensor signal or a number of wavelength dependent sensor sub-signal. The controller unit CU evaluates these signals as an indication of colour, or colour temperature.

In turn, the controller unit comprises means to adjust the driving signal PWM to alter the colour emitted by the LEDs. This can be achieved via the driving circuit DRV. The driving signal PWM is applied to different LEDs such that only certain strands or individual LEDs from the array are used or partly used. For example, when using cold and warm white LEDs their respective colours can be mixed to result in a desired mix, e.g. tuneable white. If LEDs of different colour are used a desired mixed colour can be adjusted.

In every low state OFF of the driving signal PWM the controller unit issues the ambient light enable signal ALS_en and enters the second mode. In this mode the sensor signal is processed as an ambient light signal ALS. The ambient light signal ALS includes information on the light originating from the surroundings of the optical circuit it is synchronized to states in which the LEDs are turned off. In order to evaluate the sensor signal as ambient light signal the controller unit CU comprises means process the sensor signal or the sensor sub-signals such as to indicate a level of ambient light. For example, if several sensor elements with different spectral ranges are used to generate the sensor sub-signals the individual signals can be combined into an integral sensor signal, for example, by adding the individual components. This way the integral sensor signal is an indicator of the level of ambient light. Alternatively, each individual sensor signal or sub-signal can be used as an indicator of the level of ambient light. Due to the different processing by means of the controller unit CU a single optical sensor can be used for both ambient light sensing and colour temperature determination.

The means to adjust the driving signal PWM of the controller unit CU can be used to alter the brightness emitted by the LEDs. For example, this can be achieved by adjusting the duty cycle of the driving cycle, i.e. adjust the timing of high and low states or adjust the times during which the LEDs are turned on and off, respectively.

In another embodiment not shown the control terminal is connected to the optical sensor DET. This way such the clocked control signal is synchronized to the sensor signal instead of using the driving signal to synchronize as described above. The optical sensor will detect a low level and high level indicating that the light-emitting device is switched on and off, respectively. The succession of high and low states received in this manner is clocked as was the driving signal PWM in the embodiment of FIG. 1. The operation of a controller unit CU can then be synchronized to the sensor signal in the way described above, e.g. with respect to FIG. 2. For example, the sensor signal indicates different brightness level of light emitted by the light-emitting device.

This embodiment can also be used if the signal for driving of the LEDs is not available, e.g. the optical sensor is separated from the LED driving circuit. Thus, it is possible to distinguish ambient light signal from the LED light signal by level. For example, the light brightness is measured every 1 ms. If the measured sensor signal is low, this level is used as ambient light signal. Once the signal is high this sensor signal is used as color signal. Any measurements which have a level in-between, e.g. caused by 50% ambient light and 50% LED light are discarded. Due to the concept of the sensor placement close to the luminary it can be assumed that the signal from the light emitting device is substantially higher compared to the signal from the ambient light. Therefore the above approach can separate these two levels easily.

FIGS. 3A and 3B show exemplary embodiments of a current-to-frequency converter according to the principle presented. The drawings show too alternative implementations of a current-to-frequency converter which is used as part of the controller unit to acquire the sensor signal from the optical sensor DET.

In FIG. 3A the optical sensor DET is connected to a switchable integrator INT and a reference circuit REF. The integrator INT is further connected to a flip-flop FLP via a comparator COMP. An output of the flip-flop FLP is connected to the reference circuit REF and to a logic gate AND. The logic gate AND comprises an enable input to be provided with an enable signal.

The current-to-frequency converter is basically used to acquire the sensor signal which, for example, is a photocurrent generated in a photodiode, for a given period of time. From FIG. 2 it is apparent that the sensor signals ALS and CTS are accumulated with each measurement initiated by the enable signals ALS_en and CTS_en. The so acquired sensor signals are translated into counts per time using the current-to-frequency converter.

In particular, the sensor signals are integrated by means of the integrator INT. The integrated sensor signal ramps up and is provided at an input of the comparator COMP. There it is compared with a reference vref. Every time the integrated sensor signal reaches the level of the reference the comparator COMP is set to its high state. The flip-flop FLP generates a measure of such high states per time. A time reference is applied to the flip-flop FLP via a clock signal clk'. the flip-flop FLP outputs a count signal fOUT which is indicative of the measured sensor signal as counts per time, the time being set by the clock signal clk'. The count signal fOUT is fed to the reference circuit REF in order to initiate a reset to a reference level. The count signal fOUT is also fed to the logic gate AND. The count signal fOUT is read out if the enable signal is set at the enable input.

The embodiment of FIG. 3B is similar to the one described above. The logic gate AND, however, is replaced by a switch SW connected between the optical sensor DET and the integrator INT. The enable signal ALC_EN, CTS_EN controls the switch SW such as to enable current-to-frequency conversion only when it is applied to the circuit.

FIGS. 4A and 4B show an exemplary embodiment of a luminous panel according to the principle presented. The drawings show a section of the planar luminous panel during the first (FIG. 4B) and second mode (FIG. 4A) of operation of the optical sensor circuit (implied by the dashed box in the drawings).

The luminous panel comprises a diffuser DF, a light guide LG, and a reflector RF which are connected with each other in a stacked fashion. The light guide LG is framed with an array of light emitting diodes LED as indicated by individual diode electrical symbols. The light guide LG is adapted to guide light emitted from the light emitting diodes LED. The guided light will predominately enter the diffuser DF. The light will leave the panel as emitted light EL in a directed fashion. This happens either directly via the diffuser DF or indirectly after being reflected at reflector RF.

FIG. 4A shows the situation during the second mode of operation. During this mode the light emitting diodes LED are turned off no light EL is emitted from the panel. The optical sensor DET in this mode only detects ambient light AL reflected from the surroundings into the panel as reflected light RL.

FIG. 4B shows the situation during the first mode of operation. During this mode the light emitting diodes LED are turned on and, in addition to ambient light AL, light EL is emitted by the panel and reflected as reflected light RL back to the panel and the optical sensor DET. Consequently, the optical sensor DET detects both emitted light EL and ambient light AL as sensor signal.

The invention claimed is:

1. An optical sensor circuit, comprising:

an optical sensor designed to provide a sensor signal indicative of light incident on the optical sensor, a clock terminal to receive a clocked control signal comprising high and low states, and a controller unit connected to the optical sensor and to the clock terminal, and designed to process the sensor signal as a color signal in a first mode if the clocked control signal is in high state, and to process the sensor signal as an ambient light signal in a second mode if the clocked control signal is in low state, wherein the color signal includes color information and the ambient light signal does not include color information, the controller unit is further designed to generate a driving signal to drive a light emitting device to be connected at a control terminal, and the driving signal depends on the color and ambient light signals.

2. The optical sensor circuit according to claim 1, wherein the clock terminal is coupled to the control terminal such that the clocked control signal is synchronized to the driving signal.

3. The optical sensor circuit according to claim 1, wherein the clock terminal is coupled to the optical sensor such that the clocked control signal is synchronized to the sensor signal.

4. The optical sensor circuit according to claim 1, wherein the optical sensor is a color sensor.

5. The optical sensor circuit according to claim 4, wherein the color sensor comprises at least two sensor elements, in particular three sensor elements, each being at least one of sensitive to a corresponding spectral range of light or connected to a corresponding optical filter.

6. The optical sensor circuit according to claim 5, wherein the at least two sensor elements each generate respective sensor sub-signal indicative of light incident on the optical sensor, wherein controller unit comprises means to combine the sensor sub-signals as a function of wavelength of light and process the sensor sub-signals as the color signal indicating the color of light emitted by the light emitting device, and combine the sensor sub-signals to the ambient light signal and process the ambient light signal indicating the level of ambient light.

7. The optical sensor circuit according to claim 1, wherein the controller unit comprises a signal-to-frequency converter.

8. The optical sensor circuit according to claim 1, wherein a driver circuit is connected between the control terminal and the light emitting device, comprising:

a dc/dc converter to supply a current to the light emitting device, and a controller circuit to adjust at least one of brightness or color of the light emitting device depending on the driving signal.

9. The optical sensor circuit according to claim 1, wherein the controller unit comprises at least one of a microcontroller or control logic.

10. A luminous panel, comprising:

a transparent luminary board, an array of light emitting devices connected to the luminary board, and an optical sensor circuit according to claim 1 electrically connected to the array of light emitting devices.

11. The luminous panel according to claim 10, wherein the array of light emitting devices comprises at least one of red, green, and blue light emitting diodes, or white light emitting diodes, in particular light emitting diodes with different color temperature.

12. A method for an optical sensor circuit, comprising the steps of:

receiving light by means of an optical sensor and providing a sensor signal indicative of the incident light, receiving a clocked control signal comprising high and low states, selectively processing the sensor signal as a color signal in a first mode if the clocked control signal is in high state, and processing the sensor signal as an ambient light signal in a second mode if the clocked control signal is in low state wherein the color signal includes color information and the ambient light signal does not include color information, and generating a driving signal to drive a light emitting device depending on the color and ambient light signals.

13. The method according to claim 12, further comprising the step of synchronizing the clocked control signal to the driving signal.

14. The method according to claim 12, further comprising the step of synchronizing the clocked control signal to the sensor signal.

15. The method according to claim 12, wherein in the first mode the color signal is processed such as to indicate the color of light emitted by the light emitting device, and in the second mode the ambient light signal is processed such as to indicate the level of ambient light.

* * * * *